US005587632A

United States Patent [19]

Sakai

[11] Patent Number: 5,587,632

[45] Date of Patent: Dec. 24, 1996

[54] INJECTION APPARATUS BOTH FOR POSITIVE AND NEGATIVE IONS

[75] Inventor: Izumi Sakai, Tsukuba, Japan

[73] Assignee: National Laboratory for High Energy Physics, Tsukuba, Japan

[21] Appl. No.: 523,216

[22] Filed: Sep. 5, 1995

[30] Foreign Application Priority Data

Sep. 5, 1994 [JP] Japan ..... 6-211261

[51] Int. Cl.[6] ..... H01J 23/00; H01J 23/34; H05H 7/00; H01F 7/00

[52] U.S. Cl. ..... 315/507; 335/210

[58] Field of Search ..... 315/359.1, 361.1, 315/500–507, 5.35, 5.41, 5.42; 250/396 ML; 335/210–213

[56] References Cited

U.S. PATENT DOCUMENTS

| | | | |
|---|---|---|---|
| 2,979,635 | 4/1961 | Burleigh | 315/5.35 X |
| 4,737,726 | 4/1988 | Ueda et al. | 315/501 |
| 5,073,913 | 12/1991 | Martin | 315/507 X |
| 5,285,166 | 2/1994 | Hiramoto et al. | 315/500 X |
| 5,315,118 | 5/1994 | Mous | 250/396 ML |
| 5,477,056 | 12/1995 | Hiroka | 315/503 X |

OTHER PUBLICATIONS

IEEE, May 1991, vol. 5, pp. 2700–2702, "Design of Beam Transfer Line and Injection System of Pohang Light Source", In Soo Ko et al.

IEEE, Jun. 1981, vol. NS–28, No. 3, pp. 2767–2768, "On the Multiturn Injection of High–Power Beams into an Accumulator Ring", Philip F. Meads, Jr.

IEEE, Jul. 1994, vol. 30, No. 4, pp. 2134–2137, "The Injection Septum Magnets of the SPring–8 Storage Ring", Keiko Kumagai et al.

*Primary Examiner*—Sandra L. O'Shea
*Assistant Examiner*—Mack Haynes
*Attorney, Agent, or Firm*—Spencer & Frank

[57] ABSTRACT

An injection apparatus both for positive and negative ions comprising: a first, a third and a fourth bump magnets arranged in order on a circulation orbit, a second bump magnet arranged on said circulation orbit between the first and the third bump magnets so as to maintain a given position relative to the circulation orbit and a carbon film arranged between the second and the third bump magnets, wherein the second bump magnet is afforded with both of respective functions of a bump magnet and a septum magnet, the second bump magnet is operated as the bump magnet upon the injection of a negative ion beam, while the second bump magnet is operated as the septum magnet upon the injection of a positive ion beam.

4 Claims, 6 Drawing Sheets

INJECTION APPARATUS BOTH FOR POSITIVE AND NEGATIVE IONS

BACKGROUND OF THE INVENTION

1. Field of the Invention

The present invention relates to an injection apparatus both for positive and negative ions which can be applied on a proton accelerator, a various ion accelerator and the like.

2. Description of Related Art

In conventional ion accelerators including, for instance, a synchrotron, which are used for accelerating positive ions or negative ions, are employed to the injection apparatus which are arranged in widely different forms in response to either ions to be accelerated positive or negative.

For example, as for the injection apparatus used for the proton accelerator, a multi-turn injection system based on charge exchange by negative hydrogen ions, is generally adopted, as exemplified in FIG. 3. A negative ion injection apparatus as shown in FIG. 3 is formed by arranging bump magnets 11, 12, 13 and 14 in turn on a circulating orbit, intermediate ones 12 and 13 of which are arranged so as to make a determined offset against end ones 11 and 14 and further between intermediate ones 12 and 13 a carbon film 15 is fixedly disposed.

As shown in FIG. 4 which indicates a cross-section A—A in FIG. 3, the bump magnet 12 is formed of a magnet 12*a* having a C-shaped longitudinal cross-section, inside of which conductors 12*b* and 12*c* provided for forming single turn exciting coils are arranged in such a way that a center of a circulation orbit and a beam injection point are positioned between these conductors 12*b* and 12*c*.

In the above exemplified conventional negative ion injection apparatus, an orbit of a negative ion beam, for instance, H– ion beam which is injected into the bump magnet 12 at a determined angle is deflected, upon the injection of negative ion, that is, upon the charge conversion multiplex injection, by the bump magnetic field formed in the bump magnet 12, substantially in parallel with the circulation orbit center as shown in FIG. 3, and then, after passed through the bump magnet 12, electrons are separated from the negative ion beam by the carbon film 15, so as to be converted into a positive ion beam. This positive ion beam gets on the circulation orbit through bump magnets 13 and 14, and then, during the subsequent circulation, is injected into the bump magnet 12 along the orbit which is deflected through the bump magnet 11 as shown in FIG. 3. The orbit of this positive ion beam is deflected by the aforesaid bump magnetic field in an opposite direction to that in the case of the negative ion beam, and, as a result, flows into the negative ion beam.

In this connection, according to the function of the bump magnet 11 to 14, it is arranged that the orbit is shifted in such a way as the injected ion beam is passed through the carbon film 15 only upon the negative ion injection.

On the other hand, as for the injection apparatus used for the positive ion accelerator, a circulation orbit shift system is adopted in general, as exemplified in FIG. 5. A positive ion injection apparatus as shown in FIG. 5 is formed by arranging a septum magnet 21 afforded with a determined offset against the circulation orbit center together with bump magnets as not shown in FIG. 5 in both of upper and down streams in the circulation orbit direction.

As shown in FIG. 6 which indicates a crosssection B—B in FIG. 5, the septum magnet 21 is formed of a magnet 21*a* having a U-shaped longitudinal crosssection, inside of which conductor 21*b* and 21*c* provided for forming single turn exciting coils are arranged in such a way that a beam injection point is positioned between these conductors 21*b* and 21*c* and outside of which a center of a circulation orbit is positioned.

In the above exemplified conventional positive ion injection apparatus, an orbit of a positive ion beam which is injected into the septum magnet 21 at a determined angle is deflected, upon the injection of positive ion, that is, upon the circulation orbit shift multiplex injection, substantially in parallel with the circulation orbit center as shown in FIG. 5, by the fact that the circulation orbit which is shifted by a bump magnet as not shown in FIG. 5 is temporarily passed through a septum magnetic field formed in the septum magnet 21, and then gets on the circulation orbit through the aforesaid bump magnet as not shown in FIG. 5.

In the above exemplified conventional ion injection apparatus as shown in FIG. 4 which is used for the proton accelerator, the charge exchange injection system based on negative ions is adopted. In this charge exchange injection system based on negative ions, it is possible to efficiently inject the ion beam into the circulation orbit. However, in the case that particles being heavier than He ion are injected, upon the charge exchange effected by making negative ions to impinge with the carbon film after the injection, the decrease of injection efficiency is caused because the ratio between the charge and the mass is not constant compared from the case of proton. So that, this charge exchange injection system based on negative ions cannot be applied on the case that heavy ions are injected. In order to facilitate the injection of positive ions being heavier than He ion in the circular accelerators including the proton accelerator, it is required to further provide an additional injection apparatus, for instance, the positive ion injection apparatus as shown in FIG. 6, which comprises the septum magnet for deflecting the orbit of the injected beam substantially in parallel with the circulation orbit, as well as the bump magnet for parallelly shifting the circulation orbit in upper and lower streams of the above septum magnet, so as to inject the beam in parallel with the circulation orbit through the septum magnet during the circulation orbit is shifted.

As described above, the negative ion injection and the positive ion injection have been conventionally realized respectively by different injection apparatus. Accordingly, in the case either negative ions or positive ions are injected and accelerated through the same accelerator, it has been conventionally required to provide the aforesaid two kinds of injection apparatus, and to change these injection apparatus from each other, each time the kind of the beam to be injected is changed. For changing the injection apparatus which is set up in vacuum together with the accelerator, it is necessary to break the vacuum situation. So that, the work for this change becomes largely scaled and further requires a working term longer than three weeks. As a result, an enormous working cost is necessary for it, as well as the restriction is brought into the application of the accelerator.

SUMMARY OF THE INVENTION

The present invention is to obviate the above-mentioned difficulties.

An object of the present invention is to provide an injection apparatus both for positive and negative ions having both of respective functions of the positive ion injection apparatus and the negative ion injection apparatus.

An object of the present invention is to provide an injection apparatus both for positive and negative ions comprising: a first, a third and a fourth bump magnet arranged in order on a circulation orbit center, a second bump magnet arranged between the first and the third bump magnet so as to maintain a given position relative to the circulation orbit center and a carbon film arranged between the second and the third bump magnets, wherein the second bump magnet is afforded with both of respective functions of a bump magnet and a septum magnet, the second bump magnet being operated as the bump magnet upon the injection of a negative ion beam, as well as being operated as the septum magnet upon the injection of a positive ion beam.

Another object of the present invention is to provide an injection apparatus both for positive and negative ions comprising: a first, a third and a fourth bump magnets arranged in order on a circulation orbit center, a second bump magnet arranged between the first and the third bump magnets so as to maintain a given position relative to the circulation orbit center and a carbon film arranged between the second and the third bump magnets, wherein at the time of injecting a negative ion beam, said second bump magnet is functioned as a bump magnet, an orbit of the negative ion beam injected at a given angle is deflected in parallel with the circulation orbit through a bump magnetic field formed in the second bump magnet, electrons contained in the negative ion beam are stripped through the carbon film and converted into a positive ion beam, which gets on the circulation orbit through the third and the fourth bump magnets, and, at the time of the injection of a positive ion beam, the second bump magnet is functioned as a septum magnet, after an orbit of the positive ion beam injected at a given angle is deflected in parallel with said circulation orbit, the circulation orbit is shifted through the first bump magnet to temporarily pass through a septum magnetic field formed in the second bump magnet, the positive ion beam gets on the circulation orbit through the third and the fourth bump magnets.

Further object of the present invention is to realize an injection apparatus both for positive and negative ions which is compacted by affording respective functions of the bump magnet and the septum magnet to the second bump magnet and further by selecting either one of these functions in response to the kind of the injected beam, wherein the second bump magnet comprises the first conductor arranged outside the circulation orbit and the second and the third conductors arranged inside the circulation orbit, the bump magnetic field is formed between the first and the second conductors and the septum magnetic field is formed between the second and the third conductors.

A still further object of the present invention is to provide an injection apparatus, wherein among the first to the fourth bump magnets arranged in order on the circulation orbit center, the second bump magnet is afforded with both of respective functions of the bump magnet and the septum magnet. So that, upon the injection of negative ion beam, the charge conversion multiplex injection system based on negative ions can be realized similarly as the conventional injection apparatus as shown in FIG. 3 by making the second bump magnet to function as a bump magnet, while, upon the positive ion beam injection, the circulation orbit shift multiplex injection system based on positive ions can be realized similarly as the conventional injection apparatus as shown in FIG. 5 by making the second bump magnet to function as a septum magnet.

Another object of the present invention is to provide an injection apparatus, wherein upon the injection of a negative ion beam, the second bump magnet is affording a function as a bump magnet, after an orbit of the negative ion beam injected at a given angle is deflected in parallel with the circulation orbit through a bump magnetic field formed in the second bump magnet, electrons contained in the negative ion beam is stripped through the carbon film and converted into a positive ion beam, which gets on the circulation orbit through the third and the fourth bump magnets, so that, as a result, the charge conversion multiplex injection system based on negative ions can be realized similarly as the conventional injection apparatus as shown in FIG. 3, while, upon the injection of a positive ion beam, the second bump magnet is affording a function as a septum magnet, after on orbit of the positive ion beam injected at a given angle is deflected in parallel with the circulation orbit by making the circulation orbit shifted through the first bump magnet to temporarily pass through a septum magnetic field formed in the second bump magnet, the positive ion beam gets on the circulation orbit through the third and the fourth bump magnets, so that, as a result, the circulation orbit shift multi-turn injection system based on positive ions can be realized similarly as the conventional injection apparatus as shown in FIG. 5.

BRIEF DESCRIPTION OF THE DRAWINGS

For better understanding of the invention, reference is made to accompanying drawings, in which:

FIG. 2(*b*) is a diagram showing the bump and septum magnetic fields of the portion of the injection apparatus shown in FIG. 2(*a*).

Figure 1:
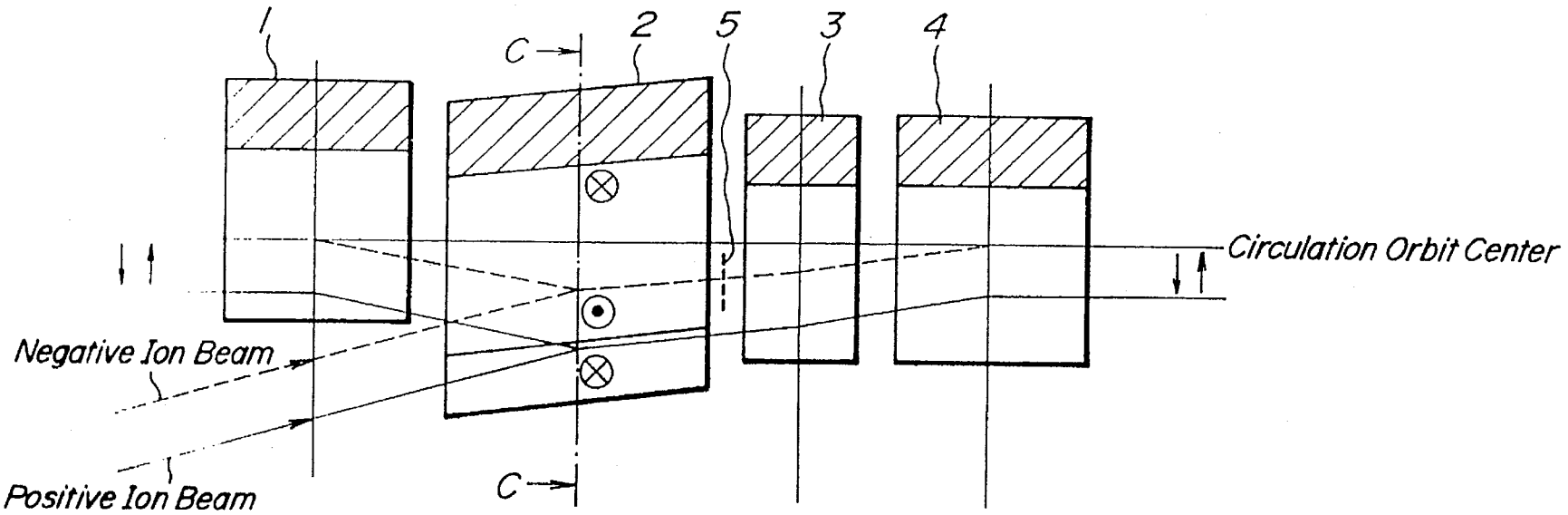
FIG. 1 is a crosssectional view showing an example in principle of an injection apparatus according to the present invention.

Throughout different views of the drawings: 1, 2 are bump magnets, 2*a* is an magnetic, 2*b*, 2*c*, 2*d* are conductors, 3,4 are bump magnets and 5 is a carbon film.

DESCRIPTION OF THE PREFERRED EMBODIMENT

An embodiment of the present invention will be described in detail hereinafter by referring to the drawings.

FIG. 1 shows an arrangement in principle of the injection apparatus both for positive and negative ions according to the present invention. The injection apparatus as shown in FIG. 1 is formed by arranging bump magnets 1, 2, 3 and 4 in order to a circulation orbit. The bump magnet 2 is substantially lozenge-shaped such as the center thereof is semewhat diagonally situated in relation to the circulation orbit center, so as to facilitate the injection of an ion beam. On the other hand, a carbon film 5 is arranged between the bump magnets 2 and 3 and fixed therein, so as to be situated almost perpendicular to the circulation orbit.

Figures 2A, 2B:
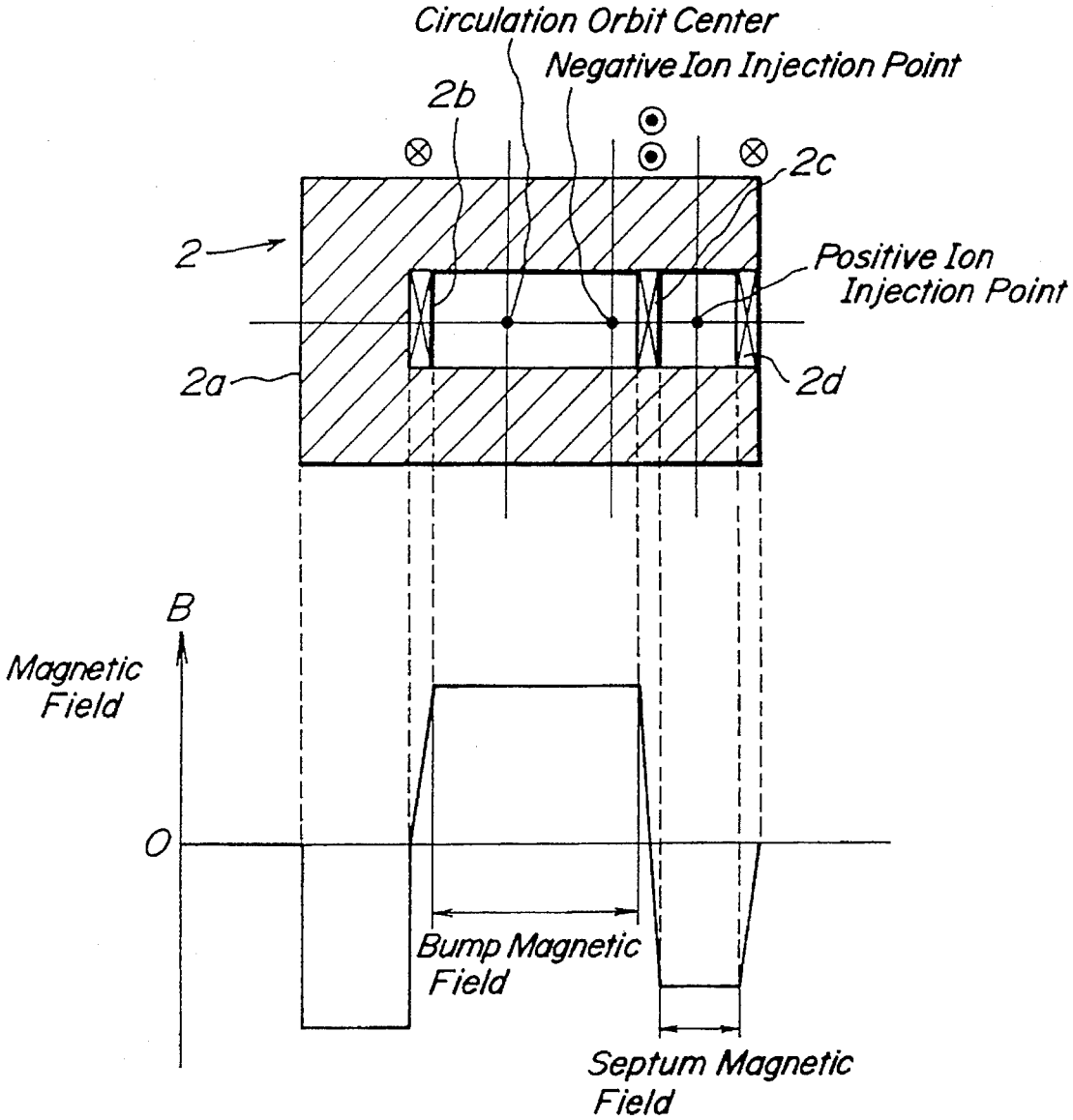
FIG. 2(*a*) is a crosssectional view along C—C of FIG. 1 showing the example as shown in FIG. 1.

As shown in FIG. 2(*a*) indicating a crosssection along C—C of FIG. 1, three conductors 2*b*, 2*c*, 2*d* respectively forming single-turn exciting coils for magnet are provided inside a magnet 2*a* having a C-shaped transverse crosssection, the circulation orbit center and the negative ion beam injection point is situated between the conductors 2*b* and 2*c*, while the positive ion beam injection point is situated between the conductors 2*c* and 2*d*. These conductors 2*b*, 2*c*, 2*d* respectively form magnetic poles which has respective polarities as shown respectively in FIG. 2, wherein the conductor 2*c* serves as a common conductor to the conductors 2*b* and 2*d*. Accordingly, as shown in FIG. 2(*b*) a bump magnetic field, which passes respectively downward at the conductor 2*b* and upward at the conductor 2*c* through a plane of the drawing, is generated between the conductors 2*b* and 2*c* by the excitation of the conductors 2*b* and 2*c*, while a septum magnetic field, which passes respectively downward at the conductor 2*d* and upward at the conductor 2*c* through the plane of the drawing, is generated by the excitation of the conductors 2*d* and 2*c*.

The function of the above mentioned embodiment will be described hereinafter.

Upon the negative ion injection, that is, upon the charge conversion multiplex injection, the bump magnet 2 is operated as a bump magnet by making exciting currents to flow through the conductors 2*b* and 2*c* of the magnet 2. In this situation, the orbit of the negative ion beam, for instance, the H– ion beam, which includes electrons injected into the bump magnet 2 at a given angle, is deflected substantially in parallel with the circulation orbit, as shown in FIG. 1, through the bump magnetic field formed in the bump magnet 2, and then, after passed through the bump magnet 2, electrons included in the negative ion beam are stripped by the carbon film 5, so as to be changed to the positive ion beam. This positive ion beam, the orbit of which is deflected through the bump magnets 3, 4 as shown in FIG. 1, gets on the circulation orbit. In the subsequent circulation, the circulating beam, that is, the positive ion beam on the circulation orbit, the orbit of which is deflected through the bump magnet 1 as shown in FIG. 1, is injected into the bump magnet 2. The orbit of this circulating ion beam, which is deflected through the same bump magnetic field in the direction opposite to that in the case of the negative ion beam, results to meet the injected negative ion beam within the bump magnet 2.

In this connection, it is arranged that the orbit of the circulating ion beam is shifted by the function of the bump magnets 1 to 4, in such a way that the injected ion beam is passed through the carbon film 5 only in the time of the negative ion beam injection.

On the other hand, upon the positive ion beam injection, that is, the circulation orbit shift multiplex injection, the conductor 2*c* in the bump magnet 2 is operated as a common conductor, that is, a septum conductor in relation to the conductors 2*b* and 2*d*, which common conductor 2*c* is supplied with an exciting current corresponding to the sum of individual exciting currents supplied between the conductors 2*b* and 2*c* and between 2*c* and 2*d* respectively, so as to operate the bump magnet 2 as a septum magnet by supplying exciting currents to all of these conductors 2*b*, 2*c* and 2*d*. At the same time, additional bump magnets as not shown in FIG. 1, provided in upper and lower reaches thereof, is excited for shifting the circulation orbit as shown in FIG. 1, wherein the bump magnet is not excited in the time of the negative ion beam being injection. Consequently, the orbit of the positive ion beam injected into the bump magnet 2 at a given angle is deflected substantially in parallel with the circulation orbit as shown in FIG. 1, by the fact that the above shifted circulation orbit is temporarily passing through the septum magnetic field formed in the bump magnet 2, and subsequently meets the circulation orbit through the bump magnets 3, 4, 1 and 2 in order. In this connection, before the injected ion beam, which has met the circulation orbit, returns to the injection point after the one round circulation, the circulation orbit is reverted to the original state by releasing the excitation of the additional bump magnets provided in upper and lower reaches, thereby the circulation is subsequently maintained on the circulation orbit of the injected beam.

As mentioned above, the injection apparatus both for positive and negative ions as shown in FIG. 1 according to the present invention, can be realized respectively through a compact arrangement, wherein said apparatus comprises a single set of arrangement, quite different two injection system, that is, both of the charge conversion injection system for accelerating protons and the circulation orbit shift injection system for accelerating positive ions. According to this injection apparatus, it is applicable for accelerating various kinds of particles, the use of the accelerator can be expanded for a multi-purpose particle accelerator in future. The change between proton acceleration and positive ion acceleration can be attained without any large-scaled change of the arrangement. It is possible in principle to change the kind of particles to be accelerated at each accelerating pulse. According to the application of this injection apparatus both positive and negative ions according to the invention, particularly, upon KEKPS, that is, Proton Synchrotron of High Energy Physics Laboratory, it is possible to effect the acceleration for both of high intensity proton beam and high energy ion beam, so as to realize multipurpose use of the particle accelerator.

It is possible that the negative ion beam and positive ion beam can be shifted simultaneously to be over-lapping on the same circulation orbit by controlling the timing of both injections.

Figure 3:
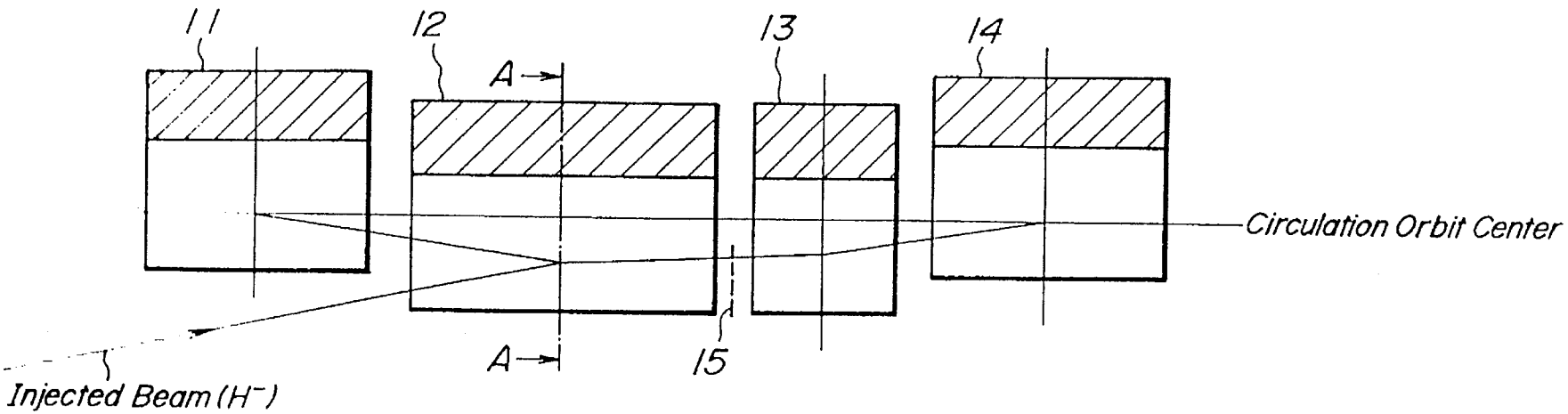
FIG. 3 PRIOR ART
FIG. 3 is a crosssectional view showing an example in principle of a conventional negative ion injection apparatus as mentioned before.
Figure 4:
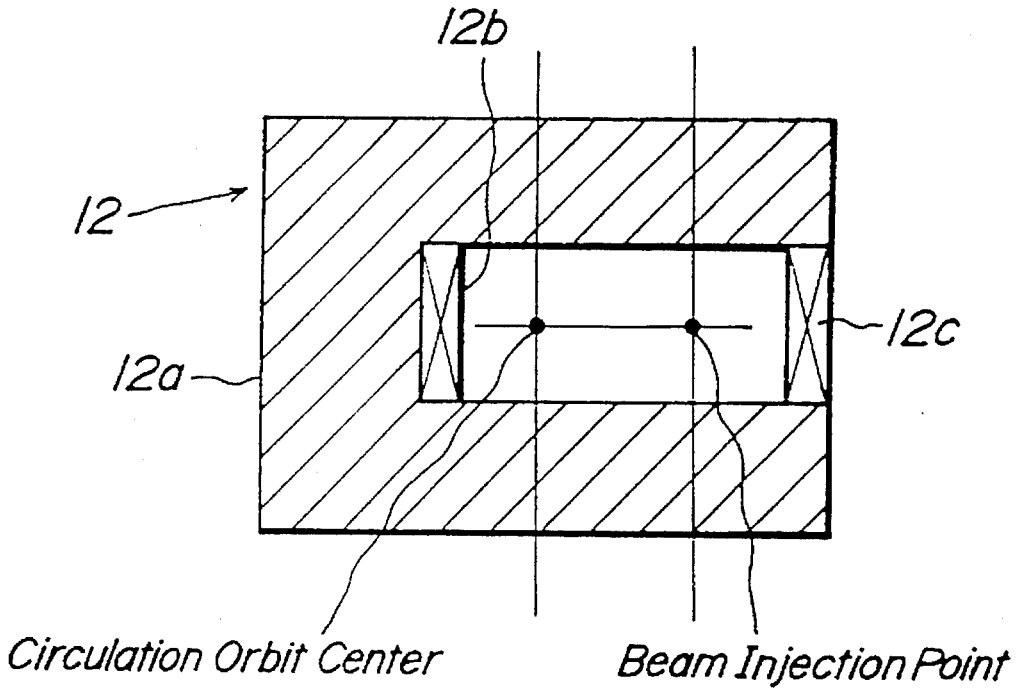
FIG 4 PRIOR ART
FIG. 4 is a crosssectional view along A—A of FIG. 3 showing the example as shown in FIG. 3.
Figure 5:
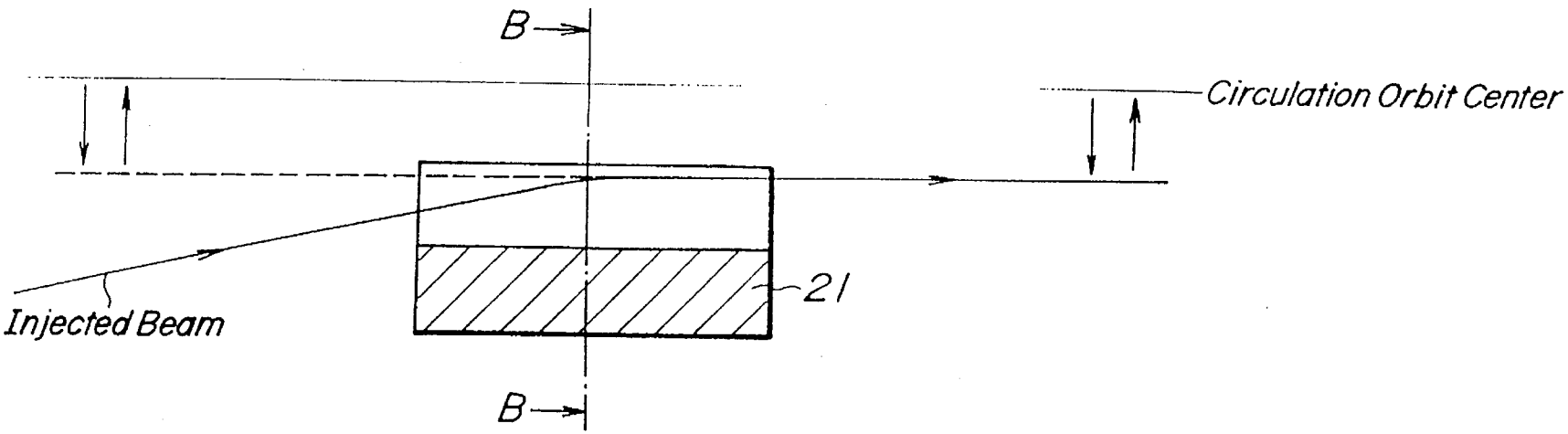
FIG 5 PRIOR ART
FIG. 5 is a crosssectional view showing an example in principle of a conventional positive ion injection apparatus as mentioned before.
Figure 6:
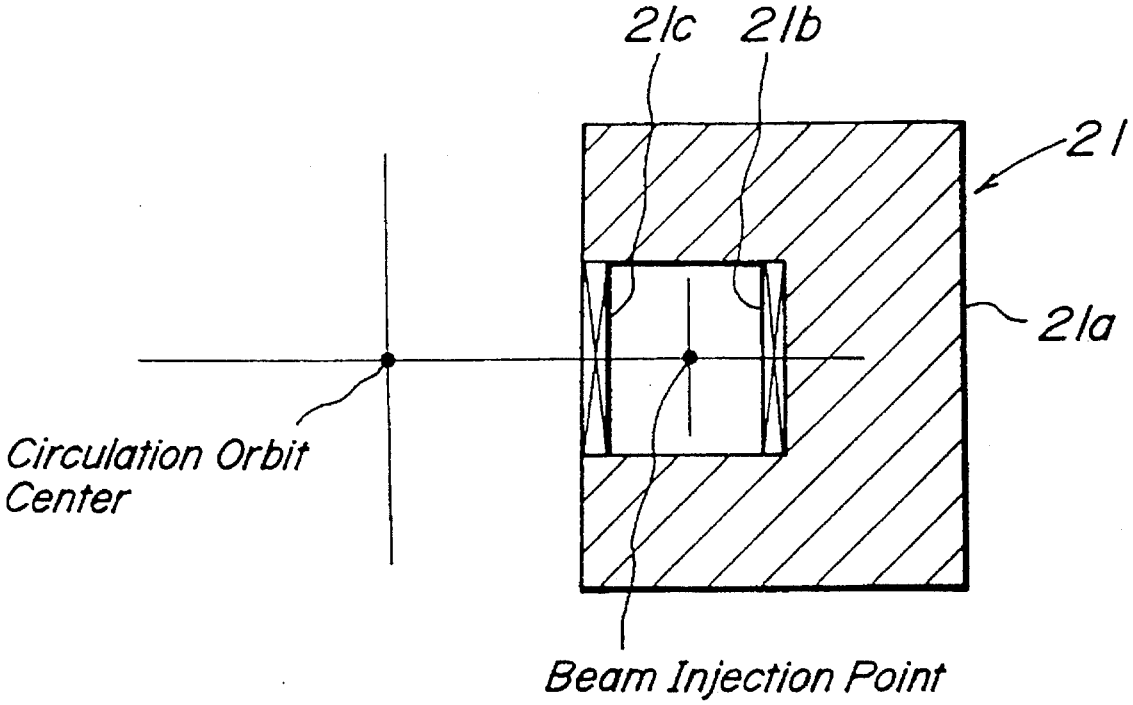
FIG 6 PRIOR ART
FIG. 6 is a crosssectional view along B—B of FIG. 5 showing the example as shown in FIG. 5.

As it is apparent from the above description, the injection apparatus both for positive and negative ions according to the present invention, can be realized similarly as the conventional injection apparatus, such that among the first to the fourth bump magnets arranged in order on the circulation orbit center, the second bump magnet is afforded with both of respective functions of the bump magnet and the septum magnet, while, upon the injection of negative ion beam, the charge conversion multiplex injection system based on negative ions can be realized similarly as the conventional injection apparatus as shown in FIG. 3 by making the second bump magnet to function as a bump magnet, and further, upon the positive ion beam injection, the circulation orbit shift multiplex injection system based on positive ions can be realized similarly as the conventional injection apparatus as shown in FIG. 5 by making the second bump magnet to function as a septum magnet.

Under the above reason, the injection apparatus both for positive ion and negative ion which is essential two kind of injection apparatus, can be compacting by uniting into one system, the accelerator make more high flexibility in the applicable field by discussing a long time and a large scale working necessary for mutually interchanging the injection apparatus upon the change of the kind of injection beam.

Moreover, the injection apparatus both for negative and positive ions according to the present invention can be realized a charge conversion multiplex injection system based on negative ions as same as the conventional injection apparatus as shown in FIG. 3, such that upon the injection of a negative ion beam, the second bump magnet is affording a function as a bump magnet, after an orbit of the negative ion beam injected at a given angle is deflected in parallel with the circulation orbit through a bump magnetic field formed in the second bump agent, electrons contained in the negative ion beam is separated through the carbon film and converted into a positive ion beam, which gets on the circulation orbit through the third and the fourth bump magnets, while upon the injection of a positive ion beam, the second bump magnet is affording a function as a septum magnet, after an orbit of the positive ion beam injected at a given angle is deflected in parallel with the circulation orbit by making the circulation orbit shifted through the first bump magnet to temporarily pass through a septum magnetic field formed in the second bump magnet, the positive ion beam gets on the circulation orbit through the third and the fourth bump magnets, so that, as a result, the circulation orbit shift multiplex injection system based on positive ions can be realized similarly as the conventional injection apparatus as shown in FIG. 5.

Consequently, according to the present invention, the apparatus which conventionally necessitates two kinds of arrangements for injecting both of positive and negative ion beams can be unified into a compact form and further to be released from the large-scaled and long term work for changing the two kinds of arrangements from each other, each time the kind of injected ion beam is changed, so as to increase the freedom in the application of the particle accelerator.

What is claimed is:

1. An injection apparatus both for positive and negative ions comprising: a first, a third and a fourth bump magnets arranged in order on a circulation orbit, a second bump magnet arranged on said circulation orbit between the first and the third bump magnets so as to maintain a given position relative to the circulation orbit and a carbon film arranged between the second and the third bump magnets, wherein the second bump magnet is afforded with both of respective functions of a bump magnet and a septum magnet, the second bump magnet is operated as the bump magnet upon the injection of a negative ion beam, as well as the second bump magnet is operated as the septum magnet upon the injection of a positive ion beam.

2. An injection apparatus both for positive and negative ions comprising: a first, a third and a fourth bump magnets arranged in order on a circulation orbit, a second bump magnet arranged on said circulation orbit between the first and the third bump magnets so as to maintain a given position relative to the circulation orbit and a carbon film arranged between the second and the third bump magnets, wherein upon the injection of a negative ion beam, the second bump magnet is affording a function as a bump magnet, after an orbit of the negative ion beam injected at a given angle is deflected in parallel with the circulation orbit through a bump magnet field formed in the second bump magnet, electrons contained in the negative ion beam are separated through the carbon film and converted into a positive ion beam, which gets on the circulation orbit through the third and the fourth bump magnets, wherein upon the injection of a positive ion beam, the second bump magnet is affording a function as a septum magnet, after an orbit of the positive ion beam injected at a given angle is deflected in parallel with the circulation orbit by making the circulation orbit shifted through the first bump magnet to temporarily pass through a septum magnetic field formed in the second bump magnet, the positive ion beam gets on the circulation orbit through the third and the fourth bump magnets.

3. An injection apparatus both for positive and negative ions as claimed in claim 1, wherein the second bump magnet comprises a first conductor arranged outside the circulation orbit and a second and a third conductors arranged outside the circulation orbit, a bump magnetic field is formed between the first and the second conductors and a septum magnetic field is formed between the second and the third conductors.

4. An injection apparatus both for positive and negative ions as claimed in claim 2, wherein the second bump magnet comprises a first conductor arranged outside the circulation orbit and a second and a third conductors arranged outside the circulation orbit, a bump magnetic field is formed between the first and the second conductors and a septum magnetic field is formed between the second and the third conductors.

* * * * *